US006484043B1

(12) United States Patent
Klein et al.

(10) Patent No.: US 6,484,043 B1
(45) Date of Patent: Nov. 19, 2002

(54) DUAL MODE MICROWAVE BAND PASS FILTER MADE OF HIGH QUALITY RESONATORS

(75) Inventors: Norbert Klein, Mönchengladbach (DE); Andreas Scholen, Würselen (DE)

(73) Assignee: Forschungszentrum Jülich GmbH, Jülich (DE)

( * ) Notice: Subject to any disclaimer, the term of this patent is extended or adjusted under 35 U.S.C. 154(b) by 0 days.

(21) Appl. No.: 09/180,160

(22) PCT Filed: Apr. 26, 1997

(86) PCT No.: PCT/DE97/00857

§ 371 (c)(1),
(2), (4) Date: Nov. 3, 1998

(87) PCT Pub. No.: WO97/42679

PCT Pub. Date: Nov. 13, 1997

(30) Foreign Application Priority Data

May 3, 1996 (DE) ..... 196 17 698

(51) Int. Cl.[7] ..... H01P 1/20; H01B 12/02

(52) U.S. Cl. ..... 505/210; 333/99 S; 333/202; 333/219.1; 505/700; 505/866

(58) Field of Search ..... 333/202, 219.1, 333/235, 99 S; 505/210, 700, 701, 866

(56) References Cited

U.S. PATENT DOCUMENTS 5,179,074 A 1/1993 Fiedziuszko et al. ... 505/700 X
5,324,713 A * 6/1994 Shen ..... 505/210

FOREIGN PATENT DOCUMENTS

DE 37 06 965 A1 9/1987
EP 0 387 705 A2 3/1990
EP 0 496 512 A1 1/1992
EP 0 656 670 A2 12/1994

OTHER PUBLICATIONS

Pao, Chie–Shen et al.; "A Superconducting–Dielectric Resonator at W–Band" *1988 IEEE MTT–S Syposium Digest;* vol. 1; pp 457–458; May 1988.*

Patent Abstract of Japan, Patent No. 4–144302(A) "Band Pass Filter", E–1259, Sep. 4, 1992, vol. 16, No. 420.

Patent Abstract of Japan, Patent No. 1–144701(A) "Dielectric Resonator", E–817, Sep. 7, 1989, vol. 13, No. 404.

Nobuaki Imai et al "A Design Of High–Q Dielectric Resonators for MIC Applications" Electronics and Communications in Japan, vol. 67–B, No. 12, 1984 pp. 59–67.

N. Tellmann et al. "High–Q $LaA1O_3$ Dielectric Resonator Shielded by YBCO–Films" IEEE Transactions on Applied Superconductivity, No. 3, vol. 4, Sep. 1994, pp. 143–148.

* cited by examiner

*Primary Examiner*—Benny T. Lee
(74) *Attorney, Agent, or Firm*—Collard & Roe, P.C.

(57) ABSTRACT

The object of the invention is a dual-mode band pass filter consisting of resonators each having a spherically shaped dielectric arranged on at least one high-temperature superconductive film, with a shielding housing, which is arranged over the high-temperature superconductive film and which encloses the dielectric, and with a coupling device for coupling the dipole modes, as well as other coupling and tuning elements.

13 Claims, 2 Drawing Sheets

DUAL MODE MICROWAVE BAND PASS FILTER MADE OF HIGH QUALITY RESONATORS

BACKGROUND OF THE INVENTION

1. Field of the Invention

The present invention relates to a dual-mode two-pole filter such as, for example a band pass filter for the microwave range, consisting of a resonator for two dipole modes each having a dielectric arranged on at least one high-temperature superconductive film, with a shielding housing arranged over the high-temperature superconductive film and enclosing the dielectric, and with a coupling device for coupling the dipole modes and in particular for coupling microwaves to the electromagnetic fields of the dipole modes employed. The invention, furthermore, relates to a multipole dual-mode filter.

2. Prior Art

In the satellite communications technology, band pass filters in the microwave range (4 to 20 GHz) play an important role in the preselection of individual communication channels. Analog multiplexers are usually employed there with filters based on hollow resonators, in connection with which the quality factors of the individual resonators are in the range of a few $10^4$. The hollow resonators, which have a circular cylindrical shape in most cases, are mostly operated in so-called "dual modes", i.e., orthogonal dipole modes with preferred direction of the electromagnetic fields in the circular area. This loads to the fact that two poles of a filter can be realized with one resonator, i.e., an n-pole filter based on dual-mode resonators consists of n/2 resonators.

Now, in satellite communications technology, miniaturization of the filters is important on the one hand, and reduction of the insertion attenuation is important mainly for the output multiplexers on the other. This reduction in insertion attenuation leads to the fact that it is possible to reduce the high-frequency output of the output stages, which is normally generated by tube amplifiers (travelling-wave tube amplifiers). The insertion attenuation decreases with the increasing quality factor of the individual resonators.

A highly miniaturized dual-mode filter based on dielectric resonators is known from U.S. Pat. No. 4,489,293, where use is made of the $HE_{111}$-mode of a cylindrical dielectric, which splits into two orthogonal dipole modes.

Further miniaturization of the arrangement described in the above state of the art is achieved, for example in that the cylindrical dielectric resonator is divided in half parallel with its base area and placed on a film consisting of high-temperature superconductors. The volume of the resonator is divided in half thereby (image plane).

The drawback of these arrangements lies in the fact that in the $HE_{111}$-mode employed, the loss contributions of the metallic shielding housing lead to quality factors which are only in the range of $10^4$. The cause for this is the following:

The unstressed quality factor $Q_0$ of a dielectric resonator with metallic shielding is given by the expression $$1/Q_0=\tan\delta+\Sigma R_{s,i}/G_i,$$

where tan δ is the loss tangent of the material of the dielectric resonator. Some dielectrics such as sapphires, $LaAlO_3$ and rutile have tanδ-values of a few $10^{-6}$ or even less below a temperature of T=100 K, so that qualities between $10^5$ and $10^6$ would basically be possible with cooled dielectric resonators. However, the limitation is caused by losses in the various parts of the wall of the metallic shielding housing, such losses each being characterized by the surface resistance of the wall material $R_{S,i}$ as well as by a geometric factor $G_i$ for the particular part "i" of the wall. The geometric factor G; results from the distribution of the electromagnetic fields for the given mode of oscillation of the resonator. With the mode of oscillation employed in the aforementioned state of the art, the geometric factors are so low that the qualities for a copper housing with normal conductivity come to about $10^4$. The superconductive "image plane" did not lead to higher qualities because the losses dominated in the remaining parts of the wall with normal conductivity, and also in the dielectric.

Circularly cylindrical dielectric resonators with two end plates made of high-temperature superconductive films are known from WO 93/09575. Qualities in the range of $10^6$ were demonstrated with such resonators because the geometric factor is adequately high for the normally conductive jacket surface of the cylinder in the $TE_{011}$-mode used there. However, due to the rotation symmetry of the filed distribution, the mode is not a dipole mode, so that no "dual-mode" operation is possible in this case.

Therefore, the problem of the invention is to create a dual-mode filter in connection with which the quality factors for the individual resonators are about $10^5$ to $10^6$.

SUMMARY OF THE INVENTION

According to the invention, the problem is solved for a dipole filter in that the dielectric has the shape of a hemisphere. The realization of more than two-pole filters is solved according to an arrangement where the spacing of at least two hemispherically shaped dielectrics defines the coupling between two resonators.

By shaping the dielectric according to the invention, the curved surfaces of the shielding housing have geometric factors which are sufficiently high for obtaining with one or two high-temperature superconductive films (HTS-films) the qualities required in connection with the problem on hand.

Additional embodiments of the present invention contain advantageous features for coupling to the electromagnetic fields of the dipole modes for equalizing the resonance frequency of the dipole modes as well as for adjusting the coupling between the dipole modes.

Additional advantages of the present invention are discussed below.

BRIEF DESCRIPTION OF THE DRAWINGS

An embodiment of the present invention is explained in greater detail in the following with the help of the drawings, in which.

DETAILED DESCRIPTION OF PREFERRED EMBODIMENTS

Figure 1A:
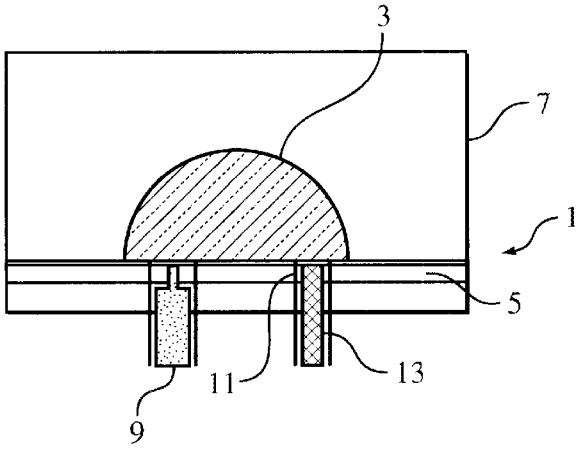
FIG. 1*a* is a schematic side view of a dual-mode two-pole filter as defined by the invention.
Figure 1B:
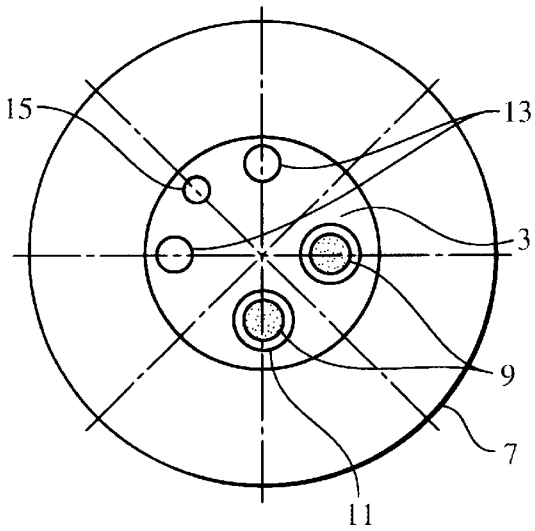
FIG. 1*b* is a schematic top view of the dual-mode two-pole filter shown in FIG. 1*a*.

FIG. 1*a* is a schematic representation showing a side view of a dual-mode two-pole filter 1 as defined by the invention. FIG. 1*b* is a schematic top view of the dual-mode two-pole filter 1 shown in FIG. 1*a*. A dielectric 3 (e.g. made from $LaAlO_3$) (FIGS. 1*a* and 1*b* ) designed in the form of a dielectric hemisphere is arranged on a high-temperature superconductive film 5 (in the following referred to as HTS-film). The invention is not limited to the arrangement of one single HTS-film; in another embodiment, provision can be made for an additional HTS-film 5 as the top end plate of a cylindrical shielding housing 7. The metallic shielding housing 7 (shown in FIGS. 1*a* and 1*b*) may have a rectangular, cylindrical or also hemispherical shape and consists of, for example preferably a metal with good conductivity such as, for example, copper.

Coupling to the two dipole modes of the "dual mode" is accomplished with a coupling device, the coupling elements 9 of which are either linear coaxial antennas (FIGS. 1*a* and 1*b*) for coupling to the electric field, or coaxial loops (not shown) for coupling to the magnetic field. Coupling elements 9 are extended through holes 11 (shown in FIGS. 1*a* and 1*b*) into the superconductive films 5.

The equalization of the resonance frequencies of the dipole modes required for the operation of filter 1 takes place via dielectric rods 13 (shown in FIGS. 1*a* and 1*b*), which are adjustable in the longitudinal direction and which consist of, for example sapphire, the rods being arranged in one plane, opposing coupling elements 9.

The coupling between the dipole modes is adjusted via another adjustable dielectric rod 15 (FIG. 1*b*), which is preferably arranged at an angle of 45° with respect to the orientation of the dipole modes.

Figure 2:
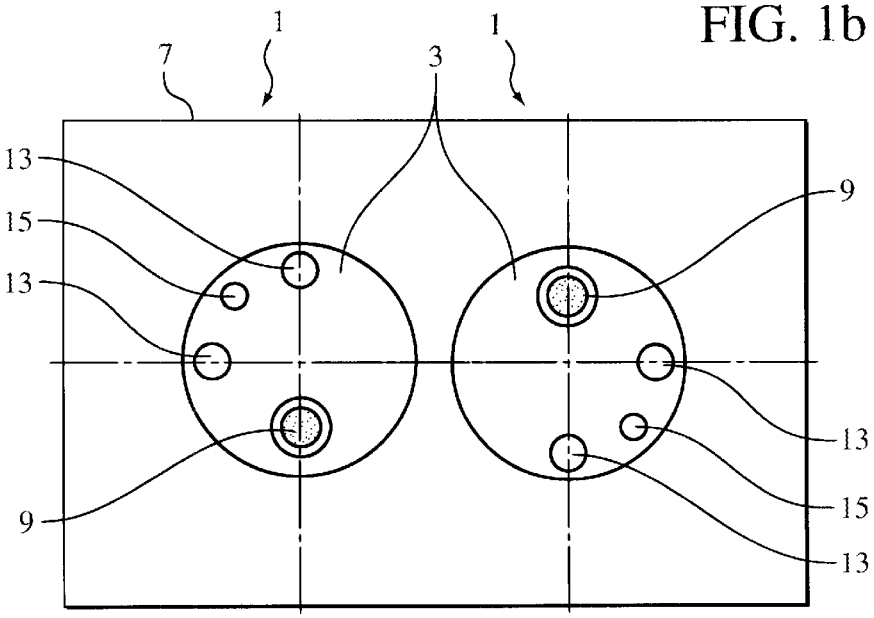
FIG. 2 is a schematic top view of a dual-mode four-pole filter as defined by the present invention.

FIG. 2 shows a four-pole filter consisting of two dual-mode resonators 1. Each resonator 1 has a dielectric 3 and a coupling element 9. The equalization of the resonance frequencies of the diphole modes takes place via dielectric rods 13. The coupling between the two resonators 1 is defined via the spacing of the two hemispheres and, if need be, may be equalized by an additional adjustable dielectric rod 15 between the hemispheres. For the purpose of realizing filters with more than four poles, a plurality of hemispheres may be arranged next to each other in the manner shown in FIG. 2.

Metallic shielding housing 7 should at all points have a spacing from the hemispherical surface conforming to at least the diameter of the hemisphere, so that losses in the shielding housing will not be excessively high.

FIGS. 3*a*, 3*b* and 4*a*, 4*b* show the field distribution within the sphere, which was computed with the help of a computer code "MAFIA" (D. Schnitt and T. Weiland: IEEE Trans. magn. 28, 1793 (1992)), and which distinctly shows the dipole nature of the mode. The symmetry of the electromagnetic fields corresponds with the $Te_{011}$-mode of the above-cited cylindrical dielectric resonator known from WO 93/09575, which is degenerated in a triple mode in a dielectric full sphere, i.e., the mode exists in three orthogonal alignments. Two of the three modes remain preserved in a dielectric hemisphere resting on a metal plate (e.g. HTS-film). This means that the metal plate describes an "image plane" of the resonator, which is disposed perpendicular to the symmetry axis of two degenerated modes.

Figure 3A:
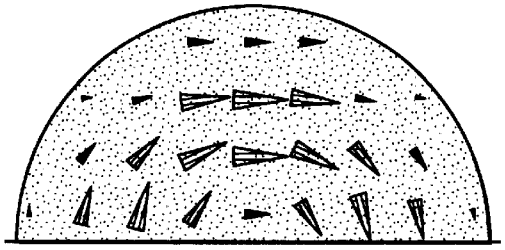
FIG. 3*a* is a schematic side view of a computed example of a distribution of the electric field in a resonator according to the present invention.
Figure 3B:
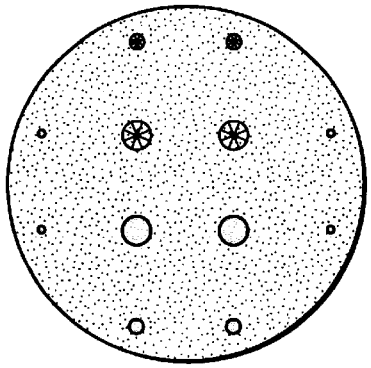
FIG. 3*b* is a schematic top view of the example shown in FIG. 3*a*.
Figure 4A:
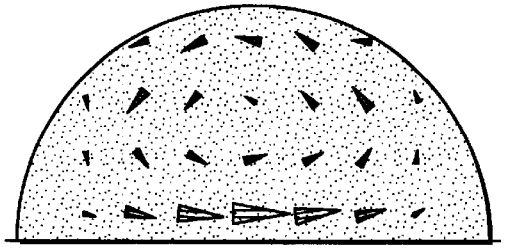
FIG. 4*a* is a schematic side view of a computed example of a distribution of the magnetic field in a resonator according to the present invention.
Figure 4B:
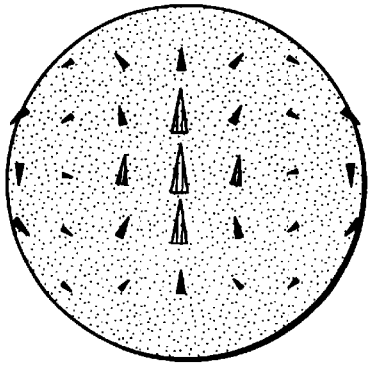
FIG. 4*b* is a schematic top view of the example shown in FIG. 4*a*.

As stated in the following in an example of computation, the loss contribution of the curved surface of the metallic shielding housing is very low. The reason for this is that as opposed to the arrangement described in the state of the art, the electric fields extend here in the hemisphere predominantly parallel with the surface of the sphere (as indicated in the arrows in FIG. 3*a*). The dipole nature of the modes is shown in FIG. 3*b*. As indicated by the arrows in FIG. 4*a*, the magnetic fields also extend in the hemisphere predominantly parallel with the surface of the sphere and have the symmetry shown in FIG. 4*b*.

In the computation example shown in either FIGS. 3*a*, 3*b* or 4*a*, 4*b*, the diameter of the hemisphere amounts to 9.6 mm, the dielectric number of the hemispherical material ($LaAlO_3$) comes to 23.4, and the diameter and height of the circularly cylindrical shielding housing amount to 26 and, respectively, 14 mm. The computation results in a resonance frequency of 6.58 GHz; the mode is the fundamental mode (lowest resonance frequency) of the resonator. The computed geometric factors amount to 114 Ω for the lower face (superconductive film), 16300 Ω for the upper face, and 10400 Ω for the jacket area. According to equation 1 this results at a temperature of 77 K with typical $R_s$-values at a resonance frequency of about 0.01 Ω for copper and about 0.002 Ω for high-temperature superconductive films in a quality factor of 300,000 and, respectively, 370,000 for one/two superconductive end plate(s). As the loss contribution of $LaAlO_3$ is about exactly as high, an overall quality of about 150,000 has to be expected.

What is claimed is:

1. A dual-mode microwave band pass filter comprising:

at least one high temperature superconductive layer;

at least one resonator for two dipole modes having a dielectric hemisphere disposed on said superconductive layer;

a shielding housing arranged above the high-temperature superconductive layer and enclosing said dielectric hemisphere; and a coupling device for coupling the dipole modes comprising coupling elements introduced from underneath the dielectric hemisphere.

2. A dual-mode microwave band pass filter according to claim 1 wherein the coupling device has two coupling elements, and wherein respective holes for receiving a corresponding coupling element are disposed in said at least one high-temperature superconductive layer.

3. The dual-mode microwave band pass filter according to claim 2 wherein the coupling elements are respective coaxial antennas.

4. The dual-mode microwave band pass filter according to claim 2 wherein the coupling elements are respective coaxial loops.

5. The dual-mode microwave band pass filter according to claim 1 further comprising a dielectric rod for adjusting the coupling between the dipole modes arranged in either said at least one high-temperature superconductive layer or in the shielding housing.

6. The dual-mode microwave band pass filter according to claim 1 wherein the shielding housing comprises metal.

7. The dual-mode microwave band pass filter according to claim 1 further comprising dielectric rods for equalizing the respective resonance frequency of the corresponding dipole modes arranged in either said at least one high temperature superconductive layer or in the shielding housing.

8. The dual-mode microwave band pass filter according to claim 7 wherein said dielectric rods are disposed opposite the coupling elements in one plane and are longitudinally adjustable relative to the plane.

9. The dual-mode microwave band pass filter according to claim 7 wherein said dielectric rods comprise sapphire.

10. The dual-mode microwave band pass filter according to claim 1 wherein the dielectric hemisphere comprises $LaAlO_3$.

11. A multipole dual-mode microwave band pass filter comprising at least two dual-mode two-pole filters, each filter comprising:

at least one respective high-temperature superconductive layer;

at least one respective resonator for two corresponding dipole modes having a dielectric hemisphere disposed on the corresponding at least one high-temperature superconductive layer;

corresponding shielding housing arranged above each respective high-temperature superconductive layer and enclosing said corresponding dielectric hemisphere; and a respective coupling device for coupling the corresponding dipole modes comprising coupling elements introduced from underneath the dielectric hemisphere.

12. The multipole dual-mode microwave band pass filter according to claim 11 wherein said dielectric hemispheres of the two-pole filters are arranged next to each other.

13. The multipole dual-mode microwave band pass filter according to claim 12 wherein the respective spacing of said dielectric hemispheres defines a corresponding coupling between the resonators of the two-pole filters.

* * * * *

UNITED STATES PATENT AND TRADEMARK OFFICE

CERTIFICATE OF CORRECTION

PATENT NO. : 6,484,043 B1
DATED : November 19, 2002
INVENTOR(S) : Klein et al.

It is certified that error appears in the above-identified patent and that said Letters Patent is hereby corrected as shown below:

Column 6,
Line 1, before the word "corresponding", please insert -- a --.

Signed and Sealed this

Nineteenth Day of August, 2003

JAMES E. ROGAN
*Director of the United States Patent and Trademark Office*